US005830286A

United States Patent [19]

Ueda et al.

[11] Patent Number: 5,830,286

[45] Date of Patent: Nov. 3, 1998

[54] STEEL RAIL HAVING EXCELLENT WEAR RESISTANCE AND INTERNAL BREAKAGE RESISTANCE, AND METHOD OF PRODUCING THE SAME

[75] Inventors: Masaharu Ueda; Kouichi Uchino, both of Kitakyushu, Japan

[73] Assignee: Nippon Steel Corporation, Tokyo, Japan

[21] Appl. No.: 737,558

[22] PCT Filed: Mar. 14, 1996

[86] PCT No.: PCT/JP96/00605

§ 371 Date: Nov. 13, 1996

§ 102(e) Date: Nov. 13, 1996

[87] PCT Pub. No.: WO96/28581

PCT Pub. Date: Sep. 19, 1996

[30] Foreign Application Priority Data

Mar. 14, 1995 [JP] Japan ..... 7-054809

[51] Int. Cl.[6] ..... C21D 8/00; C21D 9/04; C22C 38/02

[52] U.S. Cl. ..... 148/330; 148/333; 148/334; 148/581; 148/584

[58] Field of Search ..... 148/581, 584, 148/330, 333, 334

[56] References Cited

U.S. PATENT DOCUMENTS 5,658,400 8/1997 Uchino et al. ..... 148/333

FOREIGN PATENT DOCUMENTS

| | | |
|---|---|---|
| 54-25490 | 8/1979 | Japan . |
| 59-19173 | 5/1984 | Japan . |
| 61-3842 | 1/1986 | Japan . |
| 1-159327 | 6/1989 | Japan . |
| 2-200734 | 8/1990 | Japan . |
| 6-336614 | 12/1994 | Japan . |

OTHER PUBLICATIONS

Iron and Steel 65(4) (1979) Mashiro, Ueda, Kozo Fukuda, Hiroyuki Ichinose, p. S498.

Iron and Steel 66(4) (1980) Kozo Fukuda, Masahiro Ueda, Hiroyuiki Ichinose, p. S277.

*Primary Examiner*—Deborah Yee

*Attorney, Agent, or Firm*—Kenyon & Kenyon

[57] ABSTRACT

This invention provides a steel rail having wear resistance and internal breakage resistance required for a heavy load railway, containing, in terms of percent by weight, more than 0.85 to 1.20% of C, 0.10 to 1.00% of Si, 0.40 to 1.50% of Mn, 0.0005 to 0.0040% of B, at least one of 0.05 to 1.00% of Cr, 0.01 to 0.50% of Mo, 0.02 to 0.30% of V, 0.002 to 0.05% of Nb and 0.10 to 2.00% of Co, whenever necessary, being acceleratedly cooled at a cooling rate of 5° to 15° C./sec from an austenite zone temperature to 650° to 500° C., exhibiting a pearlite structure having a hardness of at least Hv 370 within the range from the surface of the rail head portion to a position having a depth of 20 mm from the head surface with this head surface being the start point, and the difference of the hardness within this range being not more than Hv 30.

4 Claims, 3 Drawing Sheets

STEEL RAIL HAVING EXCELLENT WEAR RESISTANCE AND INTERNAL BREAKAGE RESISTANCE, AND METHOD OF PRODUCING THE SAME

TECHNICAL FIELD

This invention relates to a steel rail having the improved wear resistance and internal fatigue breakage resistance required for heavy haul railways, and a method of producing the same.

BACKGROUND ART

Improvements in train speeds and loading have been made in the past as means for improving the efficiency of railway transportation. Such high efficiency of railway transportation means severe use of the rails, and further improvements in rail materials have been required. More concretely, the increase of wear is heavy in rails laid down in a curve zone of a heavy load railway, and the drop of service life of the rail has become remarkable. However, the service life of the rail has been drastically improved in recent years due to the improvements in heat-treating technologies for further strengthening the rails, and high strength rails using an eutectoid carbon steel and having a fine pearlite structure have been developed. For example, ① heat-treated rails for heavy loads having a sorbite structure or a fine pearlite structure at the head portion thereof (Japanese Examined Patent Publication (Kokoku) No. 54-25490), ② ( low alloy heat-treated rail improving not only the wear resistance but also the drop of hardness at a weld portion by the addition of alloys such as Cr, Nb, etc, (Japanese Examined Patent Publication (Kokoku) No. 59-19173), etc, have been developed.

The characterizing features of these rails are that they are high strength rails exhibiting a fine pearlite structure by a eutectoid carbon-containing steel, and are directed to improve the wear resistance.

To further accomplish higher railway transportation efficiency, however, a load of an axial direction of cargos has been strongly promoted in recent heavy load railways, and even when the rails described above are used, the wear resistance cannot be easily secured particularly in a sharply curved track, and the occurrence of the fatigue breakage inside the head portion of the rails might develop. With the background described above, rails having higher wear resistance and higher internal fatigue breakage resistance than the existing eutectoid carbon-containing high strength steel rail have been required.

DISCLOSURE OF THE INVENTION

To improve the wear resistance of the pearlite structure having the eutectoid carbon component used as the conventional rail steels and to further improve the internal fatigue breakage resistance of the rail head portion, possible means may be generally a method which improves the hardness of the pearlite structure and keeps this hardness inside the rail head portion, too.

However, the existing hardness has reached the upper limit in the high strength rails exhibiting the pearlite structure of the eutectoid carbon component. When a heat-treatment cooling rate and the addition amount of alloys are increased so as to improve the hardness and to keep the hardness inside the rail head portion, too, an abnormal hardened phase such as a martensite structure is formed in the pearlite structure, and ductility and fatigue breakage resistance of the rail are lowered.

Another means for solving the problems may be the utilization of a metallic structure having a higher wear resistance other than the pearlite structure, but no material which is more economical and has higher wear resistance than the fine pearlite structure has been found.

Therefore, inventing a rail steel which does not contain an abnormal hardened structure such as martensite, can improve the wear resistance while keeping the pearlite structure, and is effective for improving the internal fatigue breakage resistance of the rail head, and inventing a production method of such a rail steel, are the problems to be solved.

Under such circumstances, the inventors of the present invention have examined the wear mechanism of the pearlite structure, and have made the following observation.

① In addition to the increase of the hardness due to work hardening under the rolling contact with a wheel, ferrite among lamellar ferrite and cementite constituting pearlite, which has a lower hardness, is squeezed out, and only cementite having a higher hardness is thereafter deposited immediately below the rolling contact surface and secures the wear resistance.

② (The wear resistance can be drastically improved by increasing the carbon content necessary for forming cementite and increasing a cementite ratio in pearlite.

As a result of further observations of a continuous cooling transformation mechanism of a steel having a high carbon content, the inventors of the present invention have found out that when at least one of the elements which promote the formation of cementite in this high carbon content steel are complexly added, the pearlite transformation can be stably maintained to a higher continuous cooling rate than in the conventional eutectoid carbon-containing steel, or in other words, a pearlite structure not containing different structures such as an intermediate phase and martensite can be uniformly obtained in a broader cooling rate range. When this effect is employed, it is expected that a high hardness can be prevented at a position immediately below the top face of the rail head portion to the inside of the rail.

On the basis of such findings, the present invention is directed to provide a steel rail having a high wear resistance and a high internal breakage resistance required for a heavy haul railway rail.

The present invention accomplishes the object described above, and the gist of the present invention resides in a steel rail having high wear resistance and internal breakage resistance containing, in terms of percent by weight:

C: more than 0.85 to 1.20%,

Si: 0.10 to 1.00%,

Mn: 0.40 to 1.50%,

B: 0.0005 to 0.0040%, at least one of the following chemical compositions, whenever necessary:

Cr: 0.05 to 1.00%,

Mo: 0.01 to 0.50%,

V: 0.02 to 0.30%,

Nb: 0.002 to 0.05%, and

Co: 0.10 to 2.00%, and the balance of iron and unavoidable impurities, wherein the head portion of the steel rail retaining heat of a high temperature of hot rolling or heated to a high temperature for the purpose of heat-treatment is accelerated cooled at a cooling rate of 5° to 15° C./sec from an austenite zone temperature to a cooling stop temperature of 650° to 500° C., so that the steel rail exhibits a pearlite structure having a hardness of at least 370 within the range from the surface of the head portion of the steel rail to a position having a depth of at least 20 mm, and the difference of the hardness within this range is not more than Hv 30. The gist of the present invention resides also in a method of producing such a steel rail.

BEST MODE FOR CARRYING OUT THE INVENTION

Hereinafter, the present invention will be explained in detail.

First of all, the reasons for limitation of the chemical compositions of the rail steel in the present invention as described above will be explained.

C is an effective element for generating a pearlite structure and for securing a wear resistance, and 0.60 to 0.85% of C is generally used for a rail steel. When the C content is not more than 0.85%, a cementite density in the pearlite structure securing the wear resistance cannot be secured, and a drastic improvement in the wear resistance becomes difficult. When the C content exceeds 1.20%, the quantity of pro-eutectic cementite occurring in the austenite grain boundary increases, and ductility and toughness drop. Therefore, the C content is limited between more than 0.85 and 1.20%.

Si improves the strength by solid solution hardening of ferrite in the pearlite structure. However, when the Si content is less than 0.10%, its effect cannot be expected sufficiently and if its quantity exceeds 1.00%, the drop of ductility/toughness of the rail as well as weldability occurs. Therefore, the Si content is limited to 0.10 to 1.00%.

Mn is an element which is effective for increasing the strength by improving hardenability of pearlite, and restricts the formation of pro-eutectic cementite. If its content is less than 0.40%, however, the effect of Mn is small and if its content exceeds 1.50%, the formation of martensite occurs. Particularly because the formation of martensite of a chemistry segregation portion inside the rail is promoted, the Mn content is limited to 0.40 to 1.50%.

Figure 1:
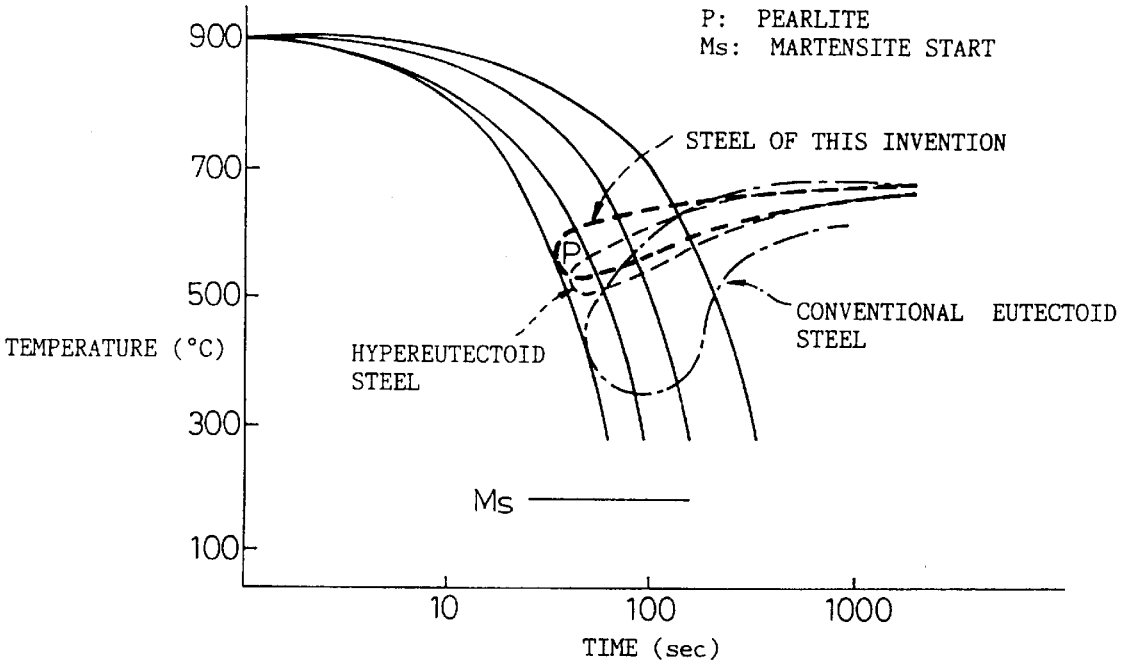
FIG. 1 is a continuous cooling curve showing the influences of the addition of B on transformation in a steel rail according to the present invention.
Figure 2:
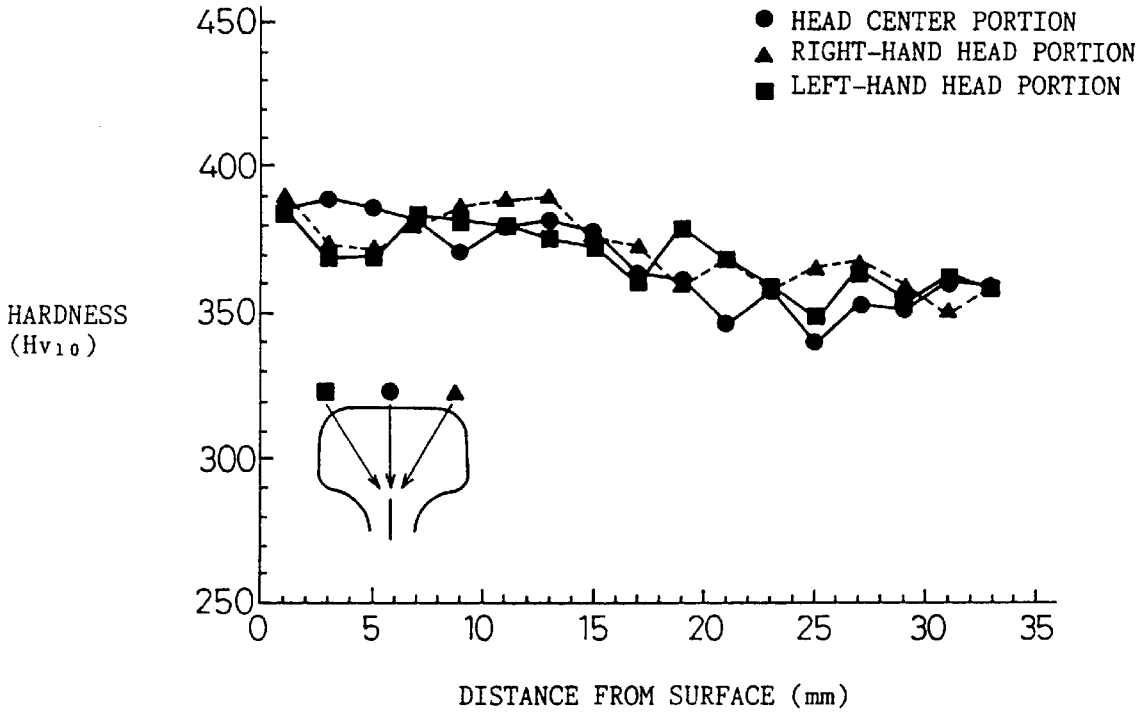
FIG. 2 is a graph showing the change of hardness from the surface after the head portion of the rail according to the present invention is heat-treated.
Figure 3A:
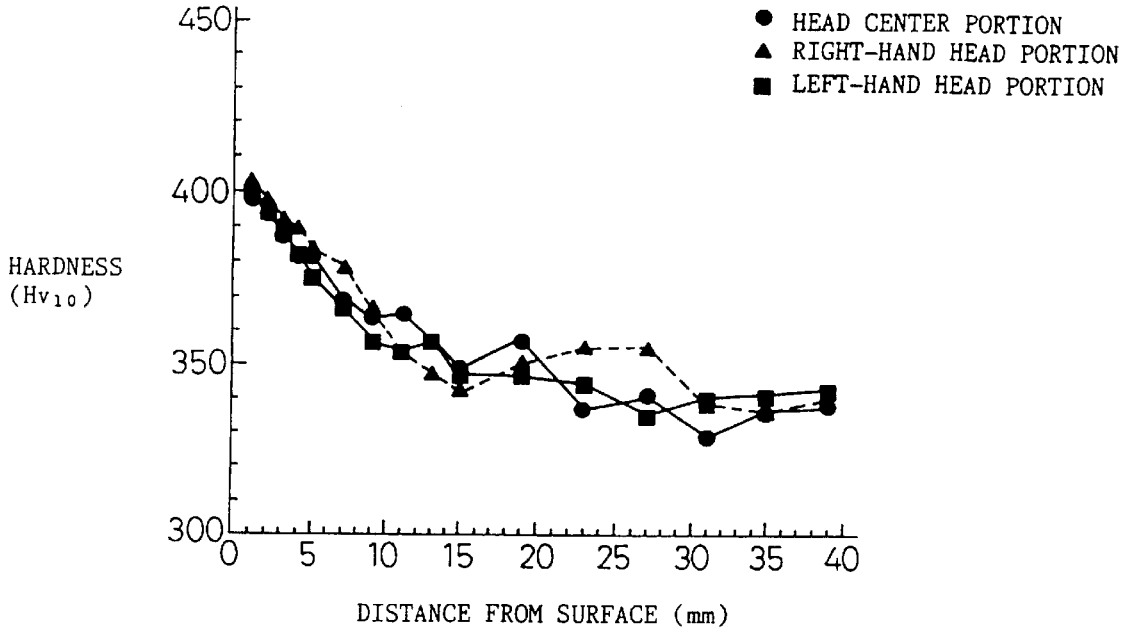
FIGS. 3(*a*) and 3(*b*) show the change of hardness from the surface of the head portion of steel rails according to the prior art after heat-treatment, wherein FIG. 3(*a*) shows an eutectoid steel rail, and FIG. 3(*b*) shows a hypereutectoid steel rail.
Figure 3B:
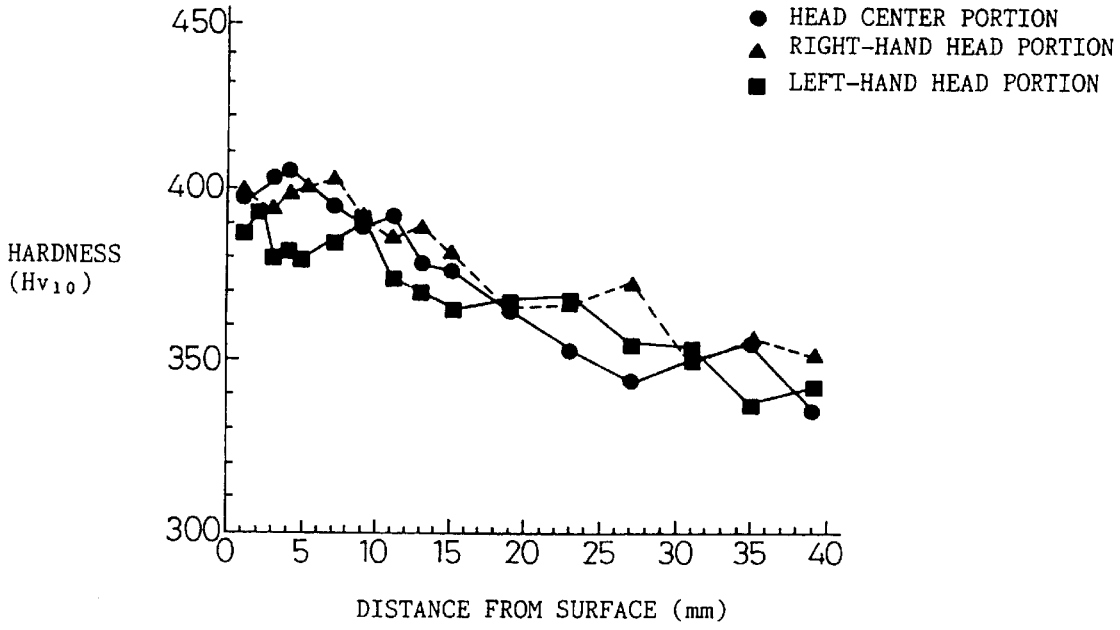

B forms boron-carbides of iron, promotes pearlite transformation, and has the effect of keeping pearlite transformation to a higher cooling rate range, during continuous cooling transformation, than the eutectoid steel or the hypereutectoid steel. FIG. 1 is a diagram showing the influences of B on the continuous cooling transformation. In the diagram, the conventional steel is an eutectoid steel (C: 0.79%, B: nil), a Comparative Steel is a hypereutectoid steel (C: 0.87%, B: nil), and a Steel of this Invention is a hypereutectoid steel + addition of B (C: 0.87%, B: 0.0029%). In this FIG. 1, the pearlite transformation at a cooling rate of near 1° to 10° C./sec shifts towards a higher temperature side in the sequence of the Conventional Steel, the Comparative Steel and the Steel of this Invention, and the difference of the transformation start temperature within the range of the same cooling rate is small. Therefore, a more uniform hardness distribution can be obtained from the surface to the inside of a rail having a distribution of the cooling rate. FIG. 2 shows the result of measurement of the hardness of the Steel of this Invention, and FIGS. 3(*a*) and 3(*b*) show the hardness distributions of the Conventional Steel and the Comparative Steel, respectively. It can be seen from these diagrams that the difference of the hardness at the position having a depth of 16 mm, for example, from the surface hardness is 20 in the Steel of this Invention, 60 in the Conventional Steel and 40 in the Comparative Steel 40. In other words, the hardness difference is improved in the Steel of this Invention. When B is less than 0.0005%, this effect is weak and when B exceeds 0.0040%, the boron-carbides of iron become coarse, so that the drop of ductility/toughness occurs. Therefore, the B content is limited to 0.0005 to 0.0040%.

Further, at least one of the following elements is added, whenever necessary, to the rail produced by the chemical composition described above in order to improve the strength, the ductility and the toughness:

Cr: 0.05 to 1.00%,

Mo: 0.01 to 0.50%,

V: 0.02 to 0.30%,

Nb: 0.002 to 0.050%,

Co: 0.10 to 2.00%.

Next, the reasons why these chemical compositions are limited as described above will be explained.

Cr raises the equilibrium transformation point of pearlite and eventually makes the pearlite structure fine, increases the strength, reinforces the cementite in the pearlite structure and improves the wear resistance. If its content is less than 0.05%, its effect is small, and an excessive addition exceeding 1.00% forms the martensite structure and invites the drop of the ductility and the toughness. Therefore, the Cr addition quantity is limited to 0.05 to 1.00%.

Mo improves hardenability of the steel and has the effect of increasing the strength of the pearlite structure. If its content is less than 0.01%, however, its effect is small and an excessive addition exceeding 0.50% forms the martensite structure and invites the drop of the ductility and the toughness. Therefore, the Mo addition quantity is limited to 0.01 to 0.50%.

Both of V and Nb form carbides/nitrides, improve the strength due to precipitation hardening or restrict the growth of the austenite crystal grains in re-heating heat-treatment, and are effective for improving the ductility and the toughness due to fining of the pearlite structure. The effect becomes remarkable when the addition quantity is within the range of 0.02 to 0.30% for V and 0.002 to 0.05% for Nb. Therefore, their quantities are limited to the ranges described above.

Co is an element which is effective for increasing the strength of pearlite. If its content is less than 0.01%, however, the effect is small and if it is added in an quantity exceeding 2.00%, the effect is saturated. Therefore, the Co quantity is limited to 0.10 to 2.00%.

The rail steel constituted by the chemical composition described above is melted in a melting furnace ordinarily used, such as a converter, an electric furnace, etc, and the molten steel is subjected to ingot making and a break down method or a continuous casting method. Furthermore, the ingot or casting is hot rolled and is shaped into the rail. Next, the head portion of the rail retaining the high temperature heat of hot rolling or a rail heated to a high temperature for the purpose of heat-treatment is acceleratedly cooled so as to improve the hardness and the distribution of the pearlite structure at the rail head portion.

Here, the reasons why the hardness of the pearlite structure is limited to at least Hv 370 within the range of a depth of at least 20 mm from the surface of the rail head portion as the start point and the difference of the hardness within such a range is limited to not more than Hv 30 will be explained.

The present invention is directed to improve the wear resistance in the heavy load railway, and from the aspect of securing its characteristics, this object can be accomplished when the hardness is at least Hv 320. From the aspect of securing the range which provides the wear resistance required for the rail head portion, the depth of at least 20 mm is necessary. On the other hand, the fine ferrite structures existing inside the rail are likely to serve as the initiation points of fatigue breakage, and the existence of such structures becomes greater when the hardness of pearlite is lower.

In the conventional rail steel exhibiting the pearlite structure, the drop of the hardness from the cooling surface to the inner direction is great when the cooling rate is within the range which does not generate the abnormal hardened structure such as martensite, and the fine ferrite structures are likely to coexist therewith inside the rail. When an attempt is made to secure the internal hardness, the abnormal hardened structure such as martensite is formed in the surface portion. To improve the internal fatigue breakage resistance while avoiding these problems, the drop of the hardness from the rail cooling surface into the inside is limited to at least Hv 370 at a position having a depth of at least 20 mm from the surface of the head portion as the start point. In other words, the surface hardness must be secured to keep the hardness to the inside. Therefore, the present invention limits the hardness of the pearlite structure to the hardness of at least Hv 370 within the depth of at least 20 mm from the rail head surface with this head surface being the start point, and limits also the difference of the hardness within this range to not more than Hv 30.

Next, the reasons why the cooling stop temperature range and the cooling rate are limited as described above will be explained.

First, the reason why the cooling stop temperature range from the austenite zone temperature is limited to 650° to 500° C. will be explained. If accelerated cooling is stopped at a temperature higher than 650° C. within the later-appearing cooling rate range of the steel of the present invention, transformation occurs immediately after accelerated cooling, so that the pearlite structure having the intended hardness cannot be obtained. If cooling is made to a temperature less than 500° C., on the other hand, sufficient recuperative heat from inside the rail cannot be obtained, and the abnormal structure such as martensite occurs at the segregation portion. For these reasons, the present invention limits the cooling stop temperature to the range of 650° to 500° C.

Next, the reason why the cooling rate (the accelerated cooling rate of the head portion) is limited to 5° to 15° C./sec will be explained.

When B is added to the steel exhibiting the pearlite structure, the transformation can be kept to the range of the high cooling rate, and this invention is based on this finding. To utilize this effect and to obtain a high hardness inside the rail while maintaining the pearlite structure, cooling at a high cooling rate is essentially necessary. Therefore, a cooling rate of at least 5° C./sec is necessary. If the cooling rate is less than this value, the hardness of the rail surface can be secured, it is true, but pearlite having a low hardness is formed inside the steel and fine ferrite which is likely to serve as the start point of the internal fatigue breakage is likely to develop. If the cooling rate exceeds 15° C./sec, on the other hand, martensite starts occurring and ductility of the rail is remarkably deteriorated. For these reasons, the present invention limits the cooling rate to 5 to 15° C./sec.

Hereinafter, Examples of the present invention will be explained in detail.

EXAMPLES

Table 1 tabulates the chemical compositions of the steel of this invention and those of the steel of Comparative Examples and their accelerated cooling conditions (cooling from the austenite zone to 650° to 500° C.), and Table 2 tabulates the Vickers' hardness at the surface portion and at a position having a depth of 20 mm in the section of the rail head portion.

TABLE 1

| | Chemical component (wt %) | | | | | | | | | Head portion accelerated cooling rate |
|---|---|---|---|---|---|---|---|---|---|---|
| Rail No. | C | Si | Mn | B | Cr | Mo | V | Nb | Co | (°C./S)* |
| Rail of Steel of This Invention | | | | | | | | | | |
| 1 | 0.90 | 0.50 | 1.00 | 0.0025 | 0.20 | — | — | — | — | 10 |
| 2 | 0.90 | 0.50 | 1.00 | 0.0025 | 0.20 | — | — | — | — | 6 |
| 3 | 0.90 | 0.20 | 0.90 | 0.0015 | — | — | 0.05 | 0.02 | — | 14 |
| 4 | 0.87 | 0.50 | 1.40 | 0.0035 | — | — | — | — | — | 7 |
| 5 | 0.90 | 0.90 | 0.60 | 0.0025 | — | 0.05 | — | — | — | 8 |
| 6 | 1.00 | 0.50 | 0.80 | 0.0030 | — | — | — | — | — | 13 |
| 7 | 1.15 | 0.20 | 1.00 | 0.0025 | — | — | — | — | 0.50 | 6 |
| Rail of Comparative Steel | | | | | | | | | | |
| 8 | 0.70 | 0.20 | 0.90 | — | — | — | — | — | — | 4 |
| 9 | 0.80 | 0.50 | 1.00 | — | 0.20 | — | — | — | — | 4 |

TABLE 1-continued

| Rail No. | Chemical component (wt %) C | Si | Mn | B | Cr | Mo | V | Nb | Co | Head portion accelerated cooling rate (°C./S)* |
|---|---|---|---|---|---|---|---|---|---|---|
| 10 | 0.90 | 0.50 | 1.00 | — | 0.20 | — | — | — | — | 3 |
| 11 | 0.90 | 0.50 | 1.00 | 0.0025 | 0.20 | — | — | — | — | 2 |
| 12 | 0.80 | 0.50 | 1.00 | — | 0.20 | — | — | — | — | 9 |

*Cooling rate from an $Ar_3$ point of the rail head portion to 500° C. after rolling.

TABLE 2

| Rail No. | | Hardness of head surface (Hv) | Hardness at 20 mm depth (Hv) | Hardness difference (Hv) |
|---|---|---|---|---|
| Rail of Steel of this Invention | 1 | 408 | 389 | 19 |
| | 2 | 402 | 380 | 22 |
| | 3 | 407 | 390 | 17 |
| | 4 | 398 | 380 | 18 |
| | 5 | 404 | 383 | 21 |
| | 6 | 409 | 391 | 18 |
| | 7 | 406 | 384 | 22 |
| Rail of Comparative Steel | 8 | 300 | 260 | 40 |
| | 9 | 395 | 362 | 33 |
| | 10 | 398 | 365 | 33 |
| | 11 | 375 | 340 | 35 |
| | 12 | 543 | 394 | 149 |

It can be appreciated from Tables 1 and 2 that the steel rails according to the present invention have sufficient hardness at the head position and the sufficient hardness distribution to secure the wear resistance and the internal fatigue breakage resistance.

Further, the hardness difference distribution was measured for each of the eutectoid steel of the conventional steel rails, the hypereutectoid steel without the addition of B and the hypereutectoid steel of the present invention with the addition of B.

Table 3 shows their chemical compositions and the head portion accelerated cooling rates, respectively.

TABLE 3

| Rails | Chemical components (wt %) C | Si | Mn | P | S | Cr | B | Head portion accelerated cooling rate (°C./S) |
|---|---|---|---|---|---|---|---|---|
| Steel of this Invention | 0.87 | 0.26 | 1.00 | 0.014 | 0.011 | 0.18 | 0.0029 | 4 |
| Eutectoid Steel | 0.79 | 0.55 | 1.07 | 0.020 | 0.010 | 0.17 | — | 4 |
| Hypereutectoid Steel | 0.89 | 0.48 | 0.62 | 0.014 | 0.006 | 0.25 | — | 4 |

FIG. 2 shows the result. In other words, the diagram shows the hardness distributions of the head center portion, the right-hand head portion and the left-hand head portion from the surface into the inside, and FIGS. 3(*a*) and 3(*b*) show the hardness distributions of the conventional eutectoid steel and hypereutectoid steel rails, respectively.

When the surface hardness and the maximum hardness at the position having a depth of 16 mm from the surface are read from these diagrams, the surface hardness Hv is 390 and the inside hardness (16 mm position) is 370 in the steel rail of the present invention, the surface hardness Hv is 400 and the inside hardness (16 mm position) is 340 in the conventional eutectoid steel rail, and the surface hardness Hv is 405 and the inside hardness (16 mm position) is 365 in the hypereutectoid steel rail. From these results, the difference of the hardness from the surface hardness is 20 in the steel rail of the present invention, 60 in the conventional eutectoid steel rail, and 40 in the hypereutectoid steel rail. In other words, it can be understood that due to the addition of B, the hardness distribution can be improved within the range from the surface to the position having the depth of 20 mm.

INDUSTRIAL APPLICABILITY

Because B is added, the steel rail according to the present invention has the effect of shifting the transformation to the higher cooling rate side than the conventional steel rail and mitigating the influences of the change of the cooling rate. Therefore, the present invention can reduce the heat-treatment hardness distribution of the surface hardness and that of the range within the depth of 20 mm from the surface, can provide uniform hardness characteristics and can improve the wear resistance and the internal fatigue breakage resistance.

We claim:

1. A steel rail having excellent wear resistance and internal fatigue breakage resistance, containing, in terms of percent by weight:

C: more than 0.85 to 1.20%,

Si: 0.10 to 1.00%,

Mn: 0.40 to 1.50%,

B: 0.0005 to 0.0040%, and the balance of iron and unavoidable impurities, wherein the range of said steel rail from the surface of the head portion thereof to a position having a depth of at least 20 mm exhibits a pearlite structure having a hardness of at least Hv 370, and the difference of the hardness within said range is not more than Hv 30.

2. A steel rail having excellent wear resistance and internal fatigue breakage resistance, containing, in terms of percent by weight:

C: more than 0.85 to 1.20%,

Si: 0.10 to 1.00%,

Mn: 0.40 to 1.50%,

B: 0.0005 to 0.0040%, at least one of the following chemical compositions, whenever necessary:

Cr: 0.05 to 1.00%,

Mo: 0.01 to 0.50%,

V: 0.02 to 0.30%,

Nb: 0.002 to 0.05%, and

Co: 0.10 to 2.00%, and the balance of iron and unavoidable impurities, wherein the range of said steel rail from the surface of the head portion thereof to a position having a depth of at least 20 mm exhibits a pearlite structure having a hardness of at least Hv 370, and the difference of the hardness within said range is not more than Hv 30.

3. A production method of a steel rail having excellent wear resistance and internal fatigue breakage resistance, containing, in terms of percent by weight:

C: more than 0.85 to 1.20%,

Si: 0.10 to 1.00%,

Mn: 0.40 to 1.50%,

B: 0.0005 to 0.0040%, and the balance of iron and unavoidable impurities, said method characterized in that the head portion of said steel rail retaining heat of a high temperature of hot rolling or heated to a high temperature for the purpose of heat-treatment is acceleratedly cooled at a cooling rate of 5° to 15° C./sec from an austenite zone temperature to a cooling stop temperature of 650° to 500° C., so that said steel rail exhibits a pearlite structure having a hardness of at least Hv 370 within the range from the surface of the head portion of said steel rail to a position having a depth of at least 20 mm, and the difference of the hardness within said range is not more than Hv 30.

4. A production method of a steel rail having excellent wear resistance and internal fatigue breakage resistance, containing, in terms of percent by weight:

C: more than 0.85 to 1.20%,

Si: 0.10 to 1.00%,

Mn: 0.40 to 1.50%,

B: 0.0005 to 0.0040%, at least one of the following chemical compositions, whenever necessary:

C: 0.05 to 1.00%,

Mo: 0.01 to 0.50%,

V: 0.02 to 0.30%,

Nb: 0.002 to 0.05%, and

Co: 0.10 to 2.00%, and the balance of iron and unavoidable impurities, said method characterized in that the head portion of said steel rail retaining heat of a high temperature of hot rolling or heated to a high temperature for the purpose of heat-treatment is acceleratedly cooled at a cooling rate of 5° to 15° C./sec from an austenite zone temperature to a cooling stop temperature of 650° to 500° C., so that said steel rail exhibits a pearlite structure having a hardness of at least Hv 370 within the range from the surface of the head portion of said steel rail to a position having a depth of at least 20 mm, and the difference of the hardness within said range is not more than Hv 30.

* * * * *